US011402110B2

(12) United States Patent
Dowling

(10) Patent No.: US 11,402,110 B2
(45) Date of Patent: Aug. 2, 2022

(54) PRESSURE EQUALIZATION DEVICE FOR ATTIC

(71) Applicant: James Dowling, North Lauderdale, FL (US)

(72) Inventor: James Dowling, North Lauderdale, FL (US)

( * ) Notice: Subject to any disclaimer, the term of this patent is extended or adjusted under 35 U.S.C. 154(b) by 196 days.

(21) Appl. No.: 16/910,703

(22) Filed: Jun. 24, 2020

(65) Prior Publication Data

US 2021/0404674 A1 Dec. 30, 2021

(51) Int. Cl.
*F24F 8/10* (2021.01)
*F24F 7/10* (2006.01)

(52) U.S. Cl.
CPC . *F24F 8/10* (2021.01); *F24F 7/10* (2013.01)

(58) Field of Classification Search
CPC ..... F24F 7/10; F24F 8/10
USPC ..... 454/255
See application file for complete search history.

(56) References Cited

U.S. PATENT DOCUMENTS 5,330,386 A * 7/1994 Calandra ..... F24F 7/02 454/339
6,346,042 B1 * 2/2002 Parker ..... F24F 7/02 55/385.2
7,497,773 B1 * 3/2009 Schmidt ..... F24F 7/025 182/77
2002/0098793 A1 * 7/2002 Achen ..... F24F 13/084 454/271

* cited by examiner

*Primary Examiner* — Allen R. B. Schult
(74) *Attorney, Agent, or Firm* — Johnson & Martin, P.A.; James David Johnson

(57) ABSTRACT

A pressure equalization device for installation on or at an entry of an attic of a home or other building is described. The pressure equalization device can be an access panel of an attic access hatch. The access panel is a solid, generally flat panel of material such as wood or plastic. The access panel includes an aperture that passes therethrough. The aperture is covered with an air-permeable cover made from a material such as cloth or plastic mesh. The mesh is constructed to allow air to pass through the aperture between the attic and interior of the building for purposes of equalizing pressure between them. Pores of the mesh are sized so that insects, rodents, and other animals and dust and debris cannot pass through and into the interior of the building.

9 Claims, 2 Drawing Sheets

PRESSURE EQUALIZATION DEVICE FOR ATTIC

FIELD OF THE INVENTION

The invention relates to home construction. More particularly, the invention relates to pressure equalization devices for installation on or at an entry to an attic of a home.

BACKGROUND

Hurricanes, tornados, and other storms are known to cause changes in pressure inside homes, buildings, and other enclosed spaces. Such changes in pressure between the outside and inside of such buildings can cause structural and cosmetic damages to the buildings. For example, hurricanes can create a negative pressure within a home's attic relative to the outside of the home. Differences in pressure between the home's attic and the interior rooms of a home can cause damage by cracking the ceiling.

A need exists for apparatuses and devices capable of equalizing pressure between a building's attic and interior rooms.

SUMMARY

The invention relates to a pressure equalization device for installation on or at an entry of an attic of a home or other building is described. During hurricanes and other storms pressure differences can occur between the pressure inside the attic of the home or building as compared to the pressure inside a room or other interior space of the home or building. The pressure equalization device can be an access panel of an attic access hatch. The access panel is a solid, generally flat panel of material such as wood, metal, or plastic. The access panel includes an aperture that passes through the access panel from a first side to a second side. The aperture is covered with an air-permeable material such as cloth or plastic mesh. The mesh is constructed to allow air to pass through the aperture between the attic and interior of the building for purposes of equalizing pressure between them. Pores of the mesh are sized so that insects, rodents, and other animals and dust and debris cannot pass through and into the interior of the building.

The pressure equalization device provides an advantage in home and building construction by allowing air to pass through the aperture and mesh cover to equalize pressure inside the attic relative to the pressure inside an interior room or space of the home or building to avoid damage during hurricanes and other storms.

Accordingly, the invention features a pressure equalization device for installation at or on an attic of a building. The device includes an access panel for covering an access hatch of an attic, wherein an aperture passes through the access panel from a first side to a second side. The device also includes an air-permeable cover that is attached over the aperture. The cover is air permeable to permit movement of air between an attic a room or other interior space of a building.

In another aspect, the invention can feature the cover being or including a mesh cover.

In another aspect, the invention can feature the cover not permitting passage of animals or debris from the attic into an interior room of the building.

In another aspect, the invention can feature the access panel being or including a solid panel or sheet of material.

In another aspect, the invention can feature the access panel being or including wood, plastic, metal, a semi-metal, or a combination of two or more of the foregoing.

In another aspect, the invention can feature the first side of the access panel being an interior-facing surface that faces toward a room or other interior space of the building when the access panel is installed in place in the access hatch opening, and the second side of the access panel being an attic-facing surface that faces into the attic when the access panel is installed in place in the access hatch opening.

In another aspect, the invention can feature the cover being or including a material having pores that do not permit passage of animals, dust, or debris from the attic into the room or other interior space of the building.

In another aspect, the invention can feature the cover being permanently attached to the access panel.

In another aspect, the invention can feature the cover being removably attached to the access panel.

In another aspect, the invention can feature the cover being or including cloth fabric, plastic, foam, or a combination of two or more of these materials.

In another aspect, the invention can feature the cover being installed on the first side of the access panel.

In another aspect, the invention can feature the cover being installed on the second side of the access panel.

In another aspect, the invention can feature the cover including two or more separate covers, wherein both the front side and the second side of the aperture is covered by at least one cover.

In another aspect, the invention can feature the cover being connected to the access panel around a perimeter of the aperture by an attachment means that is or includes an adhesive, staples, screws, tacks, tape, other strips of material, or a combination of two or more of the foregoing.

The invention also features an attic access hatch that includes a frame surrounding a frame aperture, wherein the frame is installable in an opening in a ceiling or a wall to allow access to an attic of a building. The attic access hatch further includes an access panel for placement in the frame to cover and close the frame aperture, wherein an aperture passes through the access panel from a first side to a second side. The attic access hatch also includes an air-permeable cover that is attached over the aperture, wherein the cover is air permeable to permit movement of air between an attic a room or other interior space of a building.

In another aspect, the invention can feature the frame being or including wood, plastic, metal, a semi-metal, or a combination of two or more of the foregoing.

In another aspect, the invention can feature the cover including two or more separate covers, wherein both the front side and the second side of the aperture is covered by at least one cover.

A method of the invention can be used for equalizing pressure in an attic and a room or other interior space of a building. The method includes the steps of: (a) providing a pressure equalization device, which includes an access panel for covering an access hatch of an attic, wherein an aperture passes through the access panel from a first side to a second side. The pressure equalization device also includes an air-permeable cover that is attached over the aperture, wherein the cover is air permeable to permit movement of air between an attic a room or other interior space of a building. The method further includes the step of: (b) installing the pressure equalization device in an opening between an attic and a room or other interior space of a building.

Another method of the invention can include the step of the pressure equalization device further including a frame surrounding a frame aperture. The frame is installable in an opening in a ceiling or a wall to allow access to an attic of a building, and the frame receives the access panel to cover and close the frame aperture.

Another method of the invention can feature the cover including two or more separate covers, wherein both the front side and the second side of the aperture is covered by at least one cover.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
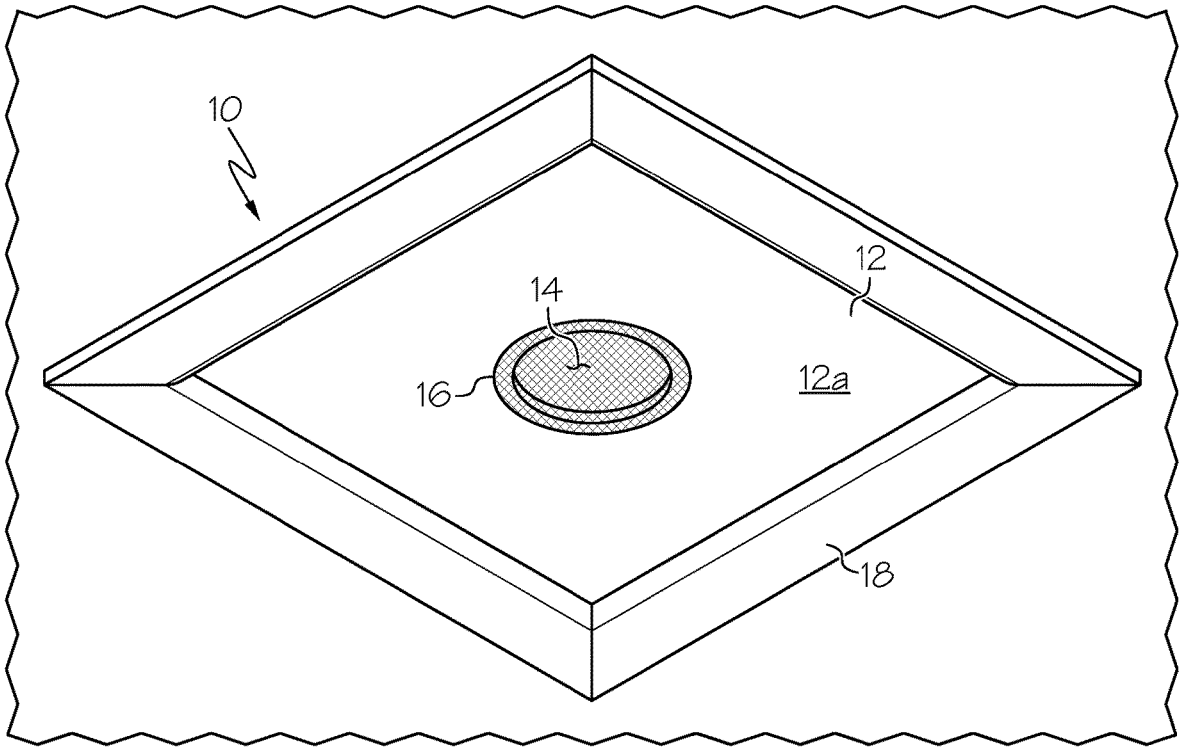
FIG. 1 is a perspective view of one embodiment of a pressure equalization device installed on a ceiling in an attic access hatch that allows access into an attic of a building.

The present invention is best understood by reference to the detailed drawings and description set forth herein. Embodiments of the invention are discussed below with reference to the drawings; however, those skilled in the art will readily appreciate that the detailed description given herein with respect to these figures is for explanatory purposes as the invention extends beyond these limited embodiments. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number of an introduced claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations; however, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

Figure 2:
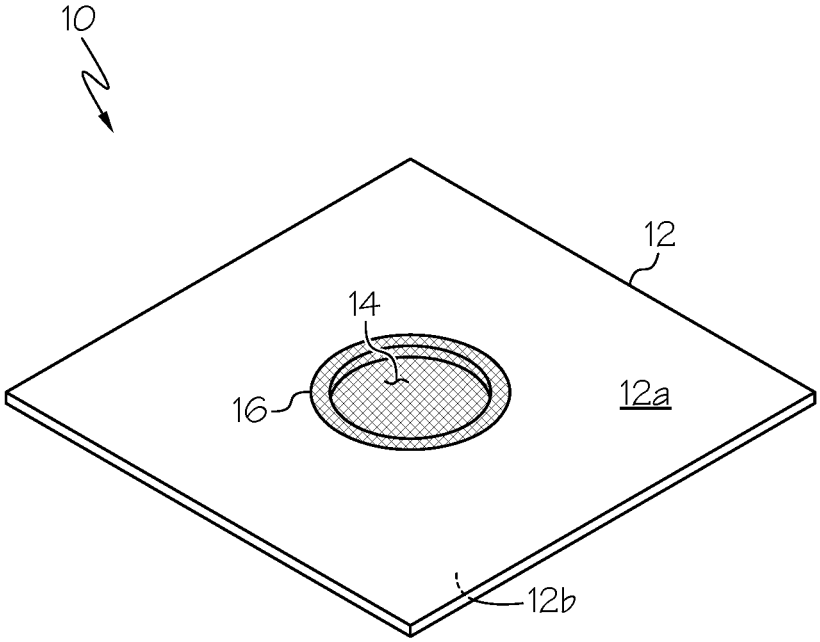
FIG. 2 is a perspective of one side of the pressure equalization device of FIG. 1, wherein the device is not installed in the attic access hatch.

The invention provides a pressure equalization device 10 for installation at or on an attic of a building, e.g., on and through a ceiling or a wall of the building that separates a room or other interior space of the building from the attic. In exemplary embodiments, such as the embodiment illustrated in FIGS. 1 and 2, the pressure equalization device 10 includes an access panel 12 for covering an access hatch of an attic. The access panel 12 includes an aperture 14, which passes through the access panel from a first side 12*a* to a second side 12*b*. The first side 12*a* of the access panel 12 is an interior-facing surface that faces toward a room or other interior space of the building when the access panel is installed in place in the access hatch opening. The second side 12*b* of the access panel 12 is an attic-facing surface that faces into the attic when the access panel is installed in place in the access hatch opening. The access panel 12 is constructed from a solid sheet or panel of material such as, for example, wood, plastic, metal, a semi-metal, or a combination of two or more of the foregoing. The access panel 12 is impermeable to air. The access panel 12 may be a type that is typically used to cover and secure an attic access hatch of a home or other building. The pressure equalization device 10 also includes an air-permeable cover 16 that is attached over the aperture 14. In exemplary embodiments, the air-permeable cover 16 is a mesh cover. For ease of reference and not for purposes of limitation, the air-permeable cover 16 is referred to herein as a mesh cover, with the understanding that other types of air-permeable covers may be used in any of the examples described herein except in any cases in which a mesh cover is explicitly required. The mesh cover 16 is air permeable so that air may pass freely between the attic of the building and a room or other interior space (e.g., a garage) of the building. In exemplary embodiments, the pressure equalization device is installed and used inside a home, although in other embodiments, the pressure equalization device may be used in other non-dwelling buildings. A home, as that term is used herein, can include a single-family home, an apartment or condominium, a townhouse, or any other type of dwelling that includes an attic.

The mesh cover 16 is constructed from a material having pores that do not permit passage of animals (including insects), dust, or debris from the attic into a room or other interior space of the building. In various embodiments of the pressure equalization device, the mesh cover 16 may be either permanently or removably attached to the access panel 12. The mesh cover 16 may be constructed from cloth fabric (cotton, nylon, polyester, or another cloth material), plastic (e.g., woven plastic), foam, or a combination of two or more of these materials. The mesh cover 16 may be installed on an interior-facing first side 12*a* of the access panel 12 or on the attic-facing second side 12*b* of the access panel 12. In some embodiments, two or more separate mesh covers may be utilized so that each side of the aperture is covered by at least one mesh cover. The mesh cover may be connected to the access panel around a perimeter of the aperture by an adhesive, staples, screws, tacks, tape, other strips of material, or any other suitable attachment means.

The embodiment of the pressure equalization device described above may be manufactured and sold as a unit, or an existing attic access panel may be adapted by cutting an aperture through it and covering the aperture with a mesh cover. For example, in exemplary embodiments, the pressure equalization device may be manufactured and sold with a frame 18 having a shape and size that receives the access panel 12 in a frame aperture (i.e., an aperture surrounded and defined by the frame) to cover and close an opening in a ceiling or wall of the room or other interior space of the building that communicates with the attic of the building. The frame, access panel, and mesh cover can be packaged and sold as a unitary attic hatch access capable of equalizing pressure in the attic and room or other interior space of the building.

In other embodiments, instead of an access panel, an aperture may be formed through a ceiling or through an attic door, which is then covered with a mesh cover as described herein. In other embodiments, the mesh cover may be installed over a can-type fixture (such as those used for ceiling mounted lights and speakers) installed in a ceiling or wall of a room or other interior space of the building, which surrounds an aperture that communicates with the attic.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. An attic access hatch comprising:

a frame surrounding a frame aperture, wherein the frame is installable in an opening in a ceiling or a wall to allow access to an attic of a building;

a flat access panel for placement in the frame to cover and close the frame aperture, wherein an aperture passes through the access panel from a first side to a second side such that a depth of the aperture is equal to a thickness of the access panel; and two or more air-permeable covers comprising a first cover and a second cover that are attached to the access panel over the aperture such that the first cover is directly attached to the first side of the panel and the second cover is directly attached to the second side of the panel, wherein the covers are air permeable to permit movement of air between the attic and a room or other interior space of the building, and wherein the two or more covers comprise cloth fabric, foam, or a combination of these materials.

2. The attic access hatch of claim 1, wherein the two or more covers are mesh covers.

3. The attic access hatch of claim 1, wherein the two or more covers do not permit passage of animals or debris from the attic into the room or other interior space of the building.

4. The attic access hatch of claim 1, wherein the access panel comprises a solid panel or sheet of material.

5. The attic access hatch of claim 1, wherein the access panel comprises wood, plastic, metal, a semi-metal, or a combination of two or more of the foregoing.

6. The attic access hatch of claim 1, wherein the first side of the access panel comprises an interior-facing surface that faces toward the room or other interior space of the building when the access panel is installed in place in the frame aperture, and wherein the second side of the access panel comprises an attic-facing surface that faces into the attic when the access panel is installed in place in the frame aperture.

7. The attic access hatch of claim 1, wherein the two or more covers are removably attached to the access panel.

8. The attic access hatch of claim 1, wherein the two or more covers further comprise plastic.

9. The attic access hatch of claim 1, wherein the two or more covers are connected to the access panel around a perimeter of the aperture by an attachment means comprising an adhesive, staples, screws, tacks, tape, other strips of material, or a combination of two or more of the foregoing.

* * * * *